US009307800B2

(12) United States Patent
Andrews et al.

(10) Patent No.: US 9,307,800 B2
(45) Date of Patent: Apr. 12, 2016

(54) HEADGEAR SAFETY APPARATUS

(71) Applicant: LDR Headgear, LLC, Windsor, WI (US)

(72) Inventors: Richard Andrews, Pompano Beach, FL (US); Dale Evans, Windsor, WI (US); Larry Marchionda, Fond Du Lac, WI (US)

(73) Assignee: LDR Headgear, LLC, Windsor, WI (US)

( * ) Notice: Subject to any disclaimer, the term of this patent is extended or adjusted under 35 U.S.C. 154(b) by 0 days.

(21) Appl. No.: 14/560,711

(22) Filed: Dec. 4, 2014

(65) Prior Publication Data

US 2015/0150330 A1 Jun. 4, 2015

Related U.S. Application Data

(60) Provisional application No. 61/911,649, filed on Dec. 4, 2013.

(51) Int. Cl.

| | |
|---|---|
| ***A42B 3/00*** | (2006.01) |
| ***A42B 3/14*** | (2006.01) |
| ***A42B 3/12*** | (2006.01) |
| ***A42B 3/20*** | (2006.01) |

(52) U.S. Cl.
CPC . *A42B 3/00* (2013.01); *A42B 3/127* (2013.01); *A42B 3/14* (2013.01); *A42B 3/205* (2013.01)

(58) Field of Classification Search
CPC ..... A42B 3/127; A42B 3/14; A42B 3/166; A42B 3/222
USPC ..... 2/414, 416, 423, 424, 425
See application file for complete search history.

(56) References Cited

U.S. PATENT DOCUMENTS

| | | | | | |
|---|---|---|---|---|---|
| 3,551,911 | A * | 1/1971 | Holden | 2/411 |
| 3,596,288 | A * | 8/1971 | Marchello | 2/421 |
| 3,628,191 | A * | 12/1971 | Douglas | 2/421 |
| 4,551,861 | A * | 11/1985 | Marchello | 2/425 |
| 5,177,815 | A * | 1/1993 | Andujar | 2/411 |
| 5,504,945 | A * | 4/1996 | Purnell | 2/425 |
| 5,790,988 | A * | 8/1998 | Guadagnino et al. | 2/411 |
| 5,882,205 | A | 3/1999 | Peterson | |
| 6,389,608 | B1 * | 5/2002 | Williams | 2/425 |
| 6,418,565 | B1 * | 7/2002 | Tsujino | 2/425 |
| 6,557,186 | B1 * | 5/2003 | Purnell | 2/425 |
| 6,564,395 | B2 * | 5/2003 | Keen | 2/425 |
| 6,715,156 | B1 | 4/2004 | Purnell | |
| 6,817,039 | B1 * | 11/2004 | Grilliot et al. | 2/413 |
| 7,603,725 | B2 * | 10/2009 | Harris | 2/413 |
| 2014/0331393 | A1 | 11/2014 | Dasilva | |

* cited by examiner

*Primary Examiner* — Tejash Patel
(74) *Attorney, Agent, or Firm* — Roberto M. Suarez

(57) ABSTRACT

This invention relates generally to the field of headgear, and, more particularly, to an apparatus for protecting the wearer from head injuries during sporting activities. The apparatus comprises at least a left side pad, a right side pad, a strap system, and optional front and rear cranial pads and chin pad. The pads are all manufactured from closed-cell, ethylene vinyl acetate foam using an injection molding process to create integrated safety features in a single, anti-microbial, safety pad.

1 Claim, 13 Drawing Sheets

HEADGEAR SAFETY APPARATUS

CROSS-REFERENCE TO RELATED APPLICATIONS

This application claims the benefit of U.S. Provisional Patent Application No. 61/911,649, filed on Dec. 4, 2013, which is incorporated herein by reference.

FIELD OF THE INVENTION

This invention relates generally to the field of headgear, and, more particularly, to an apparatus for protecting the wearer from head injuries during sporting activities.

BACKGROUND

Various sports, such as amateur wrestling, require the participant athletes to wear protective headgear. This headgear, as in the case of wrestling, typically offers minimal protection to the wearer's ears against impact, snagging, or rubbing, but offers little to no protection from impact and abrasive injuries to the frontal, rear, or temple areas of the head.

Other sports, such as girls and youth soccer, do not currently require any sort of protective headgear, but the players would benefit greatly from wearing some sort of head-impact protection as many players are suffering head injuries in these sports.

Various types of protective headgear have been developed in the current state of the art to address the need for protective headgear. Most solutions focus on protecting only the ears themselves, and seek to accomplish this by encasing hard ear cups in foam padding attached by a strap system.

Other solutions attempt to address the problem of preventing concussive injuries. Current attempts in the art address this problem with large, bulky, foam pads. These pads are cumbersome for the wearer, often need to incorporate additional, embedded plastic ear cups, and tend to breed bacteria because they do not allow the skin to breath.

Furthermore, current solutions tend to sacrifice the wearer's ability to hear in their attempts to provide protection.

Information relevant to attempts to address the problems found in the current state of the art, as described above, can be found in U.S. Pat. Nos. 5,882,205 and 6,715,156, as well as in U.S. patent application Ser. No. 14/272,577. However, each one of these references suffers from one or more of the following disadvantages: it does not address the issue of ear and concussion protection, they are not washable or anti-microbial, they are heavy and bulky, and they obscure the wearer's hearing.

It would, therefore, be desirable to have an apparatus for protecting the wearer from head injuries during sporting activities that provides for ear and concussion protection, that is washable and anti-microbial, that is light and compact, that is adjustable and customizable, and that allows for improved hearing by the wearer.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

In this specification where a document, act, or item of knowledge is referred to or discussed, this reference or discussion is not an admission that the document, act, or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY

The present invention is directed to an apparatus, the various embodiments of which protect the wearer from head injuries during sporting activities by providing for ear and/or concussion protection, that is washable and anti-microbial, that is light and compact, that is customizable, and that allows for improved hearing by the wearer.

It is contemplated that embodiments of the apparatus may be adapted for use in various different sports or activities while still being within the scope of the claims presented.

With respect to the apparatus, embodiments thereof provide for an apparatus for protecting the wearer from head injuries during sporting activities, the apparatus comprising: a left side pad, a right side pad, and a strap system, wherein said left and right side pads are mirror-images of each other and are releasably connected by said strap system to form said protective apparatus. Embodiments of the left and right side pads are each molded as a single piece with integral safety features. The safety features include, but are not limited to, a recessed portion for accepting the wearer's ear, an elongated area for protection of the wearer's temple, a plurality of raised dimples for ventilation and shock absorbency, a plurality of holes for unobstructed hearing and ventilation, and a plurality of slots and channels for fastening and guiding the strap system.

It is contemplated that the holes, as described above, may be circular holes, oval holes, or polygonal holes. It is an object of the present invention that the use of polygonal holes, for example hexagons, is preferred over circular or oval holes as the geometry of polygonal holes are better at directing and dispersing the energy of an impact than circular or oval holes.

Other embodiments of the present invention may also include either one or both of a front cranial pad and a rear cranial pad. In this way, embodiments of the present invention may comprise one, two, three, or four pads in addition to the strap system.

Additionally, embodiments of the present invention may comprise a single pad that wraps around the wearer's head, providing protection to the front and rear cranium as well as to the temples.

Additional embodiments of the present invention may further comprise a chin pad.

It is contemplated that one or more of the safety features, as described above, may be applied to any one or more of the embodiments of the apparatus and still be within the scope of the invention as disclosed and claimed herein.

The pads of the apparatus as described herein are contemplated to be manufacturable using various materials and by different processes. A preferred embodiment of the present invention may be manufactured by, but not limited to, an injection molded foam process utilizing closed-cell, ethylene vinyl acetate, anti-microbial foam. It is, therefore, and object of the invention that the pads each be constructed as individual, homogeneous pieces, as opposed to, by way of example, using a combination of materials such as a plastic cup, covered by foam, all encased in vinyl.

Certain embodiments of the present invention may be used for, but not limited to, headgear for amateur wrestling or other contact sports. For example, the apparatus may be used for soccer, rugby, lacrosse, or martial arts, where the user wishes to protect his ears, head, or ears and head. It is contemplated, however, that use of certain embodiments of the present invention in other applications beyond those described above, is within the scope of the present invention.

The present invention may address one or more of the problems and deficiencies of the prior art discussed above. However, it is contemplated that the invention may prove useful in addressing other problems and deficiencies in a number of technical areas. Therefore the claimed invention should not necessarily be construed as limited to addressing any of the particular problems or deficiencies discussed herein.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
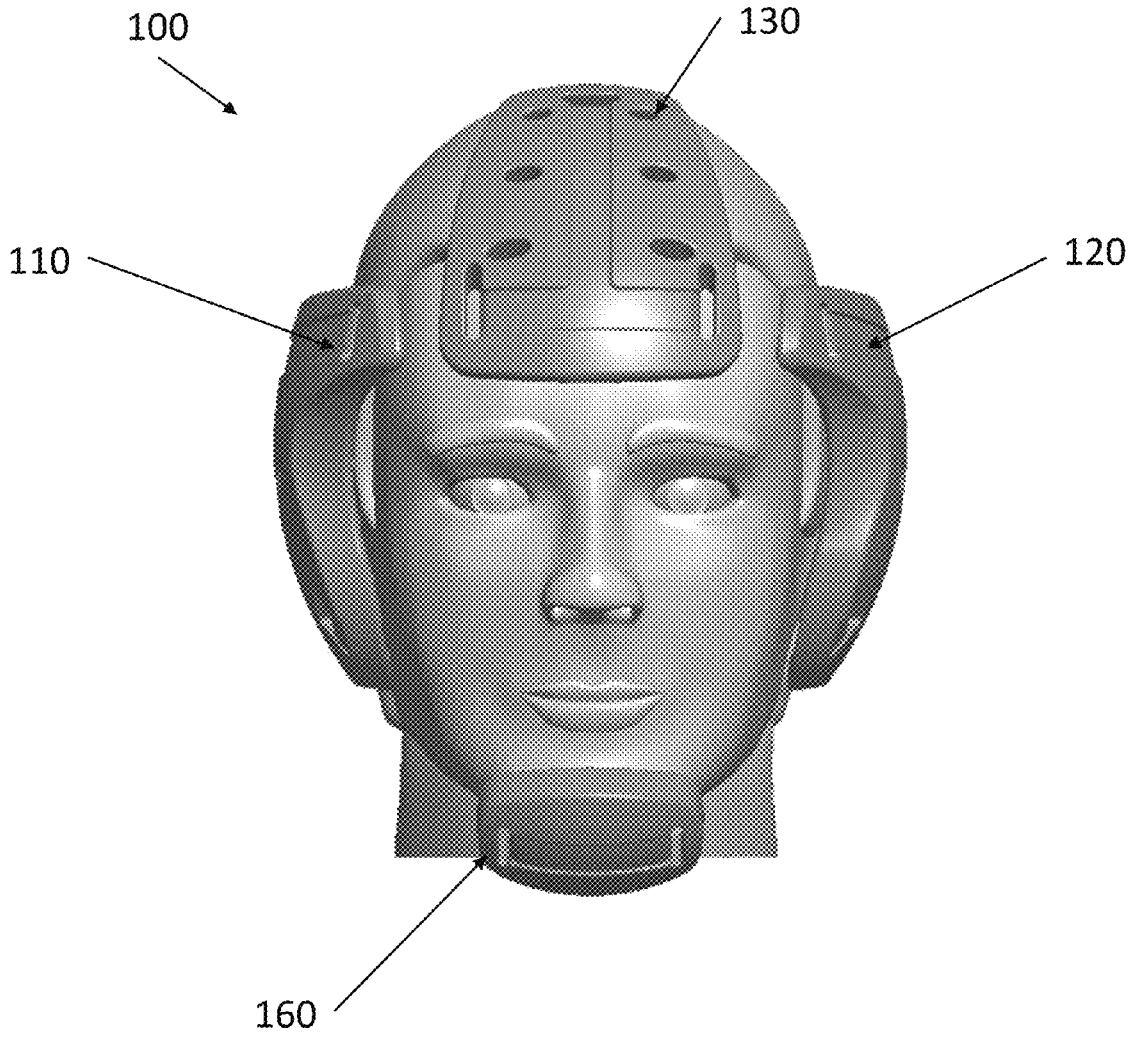
FIG. 1 is a front view in accordance with an embodiment of the present invention showing an apparatus for protecting the wearer from head injuries during sporting activities. A strap system is not shown in this figure. The human figure is shown for reference only and is not part of the claimed invention.
Figure 2:
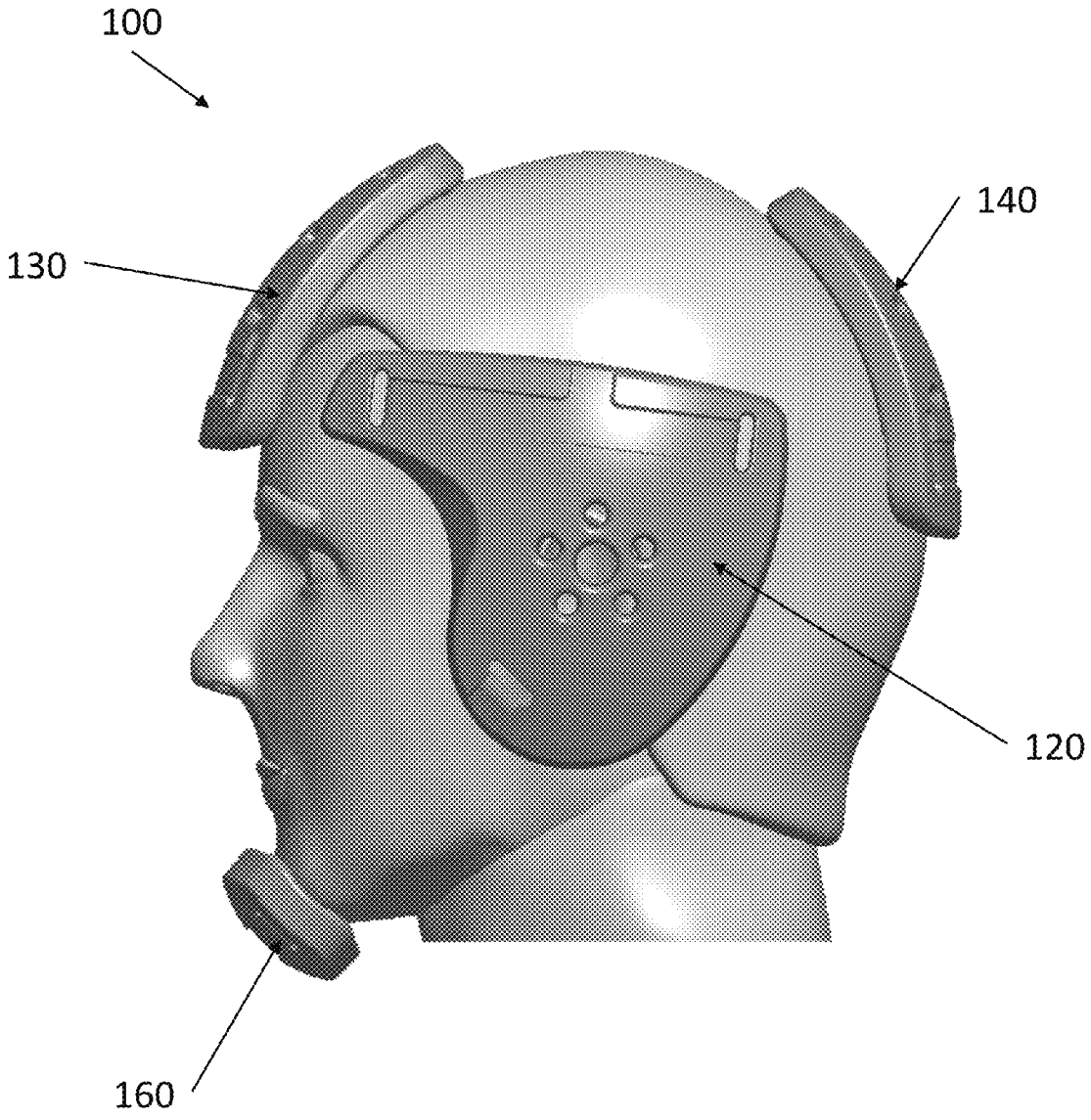
FIG. 2 is a left side view in accordance with an embodiment of the present invention showing an apparatus for protecting the wearer from head injuries during sporting activities, wherein the right side view (not presented) is a mirror image thereof. A strap system is not shown in this figure. The human figure is shown for reference only and is not part of the claimed invention.
Figure 3:
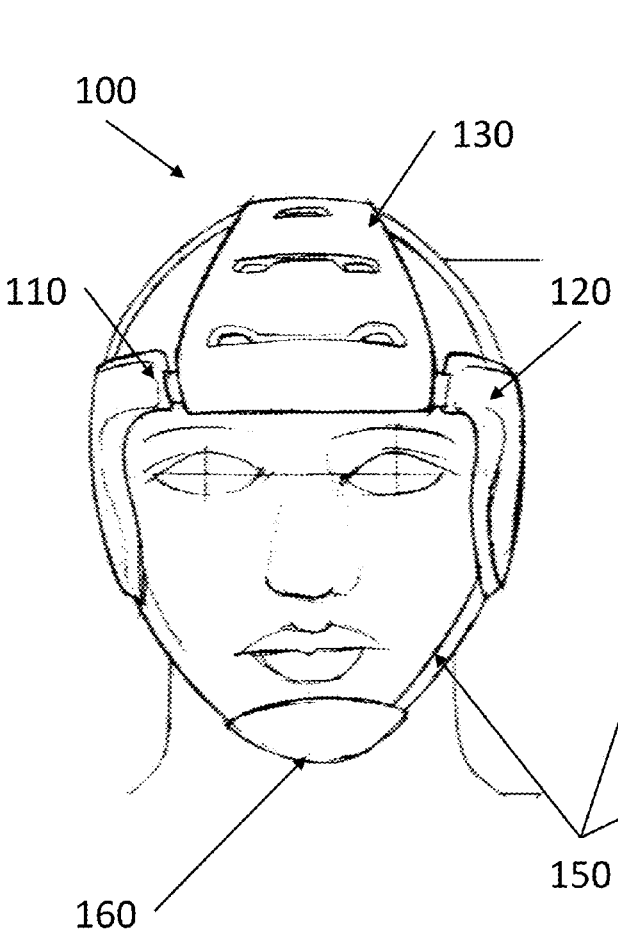
FIG. 3 is a front side view in accordance with an embodiment of the present invention showing an apparatus for protecting the wearer from head injuries during sporting activities. The human figure is shown for reference only and is not part of the claimed invention.
Figure 4:
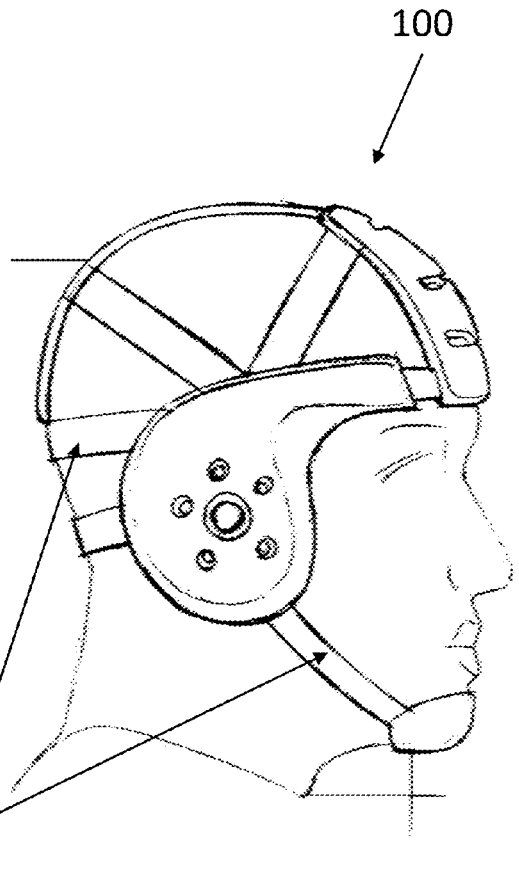
FIG. 4 is a right side view in accordance with an embodiment of the present invention showing an apparatus for protecting the wearer from head injuries during sporting activities, wherein the left side view (not presented) is a mirror image thereof. The human figure is shown for reference only and is not part of the claimed invention.

In the Summary above, in the Description and appended Claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, structures, steps, etc. are optionally present. For example, an article "comprising" (or "which comprises") components A, B, and C can consist of (i.e., contain only) components A, B, and C, or can contain not only components A, B, and C but also one or more other components or structures.

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm, and whose upper limit is 100 mm.

The terms "aperture" and "slot" are used herein to denote a structural element such as a gap, hole, or opening defined by at least a first rim on a first surface, a second rim on a second surface, and at least a third surface connecting said first rim and second rim. This type of structural element passes completely through an object and may have a cross-sectional shape such as a circle, oval, or polygon.

The term "channel" is used herein to denote a structural element defined by a portion of a surface that is recessed normal to the surrounding surface so as to create a recessed area. This type of structural element does not pass completely through an object and has the purpose of constraining another object, such as a strap.

While the specification will conclude with claims defining the features of embodiments of the invention that are regarded as novel, it is believed that the invention will be better understood from a consideration of the following description in conjunction with the figures, in which like reference numerals are carried forward.

An embodiment of the present invention is in the form of an apparatus for protecting the wearer from head injuries during sporting activities, the apparatus comprising: a left side pad, a right side pad, and a strap system, wherein said left and right side pads are mirror-images of each other and are releasably connected by said strap system to form said protective apparatus. The left and right side pads are each molded as single pieces with integral safety features. The safety features include, but are not limited to, a recessed portion for accepting the wearer's ear, an elongated area for protection of the wearer's temple, a plurality of raised dimples for ventilation and shock absorbency, a plurality of apertures for unobstructed hearing and ventilation, and a plurality of slots and channels for fastening and guiding the strap system.

It is contemplated as a feature of the present invention that the headgear is user-configurable into various embodiments. A user may configure the headgear to utilize only the side pads or to add one or both of the front or rear cranial pads, or to add the chin pad. In this way, and using the same strap system, the user can not only customize the fit of the headgear, but also the level of protection provided.

Referring to FIGS. 1-4, a preferred embodiment 100 of the present invention would comprise a left side pad 110, a right side pad 120, a front cranial pad 130, a rear cranial pad 140, a chin pad 160, and a strap system 150.

Figure 5:
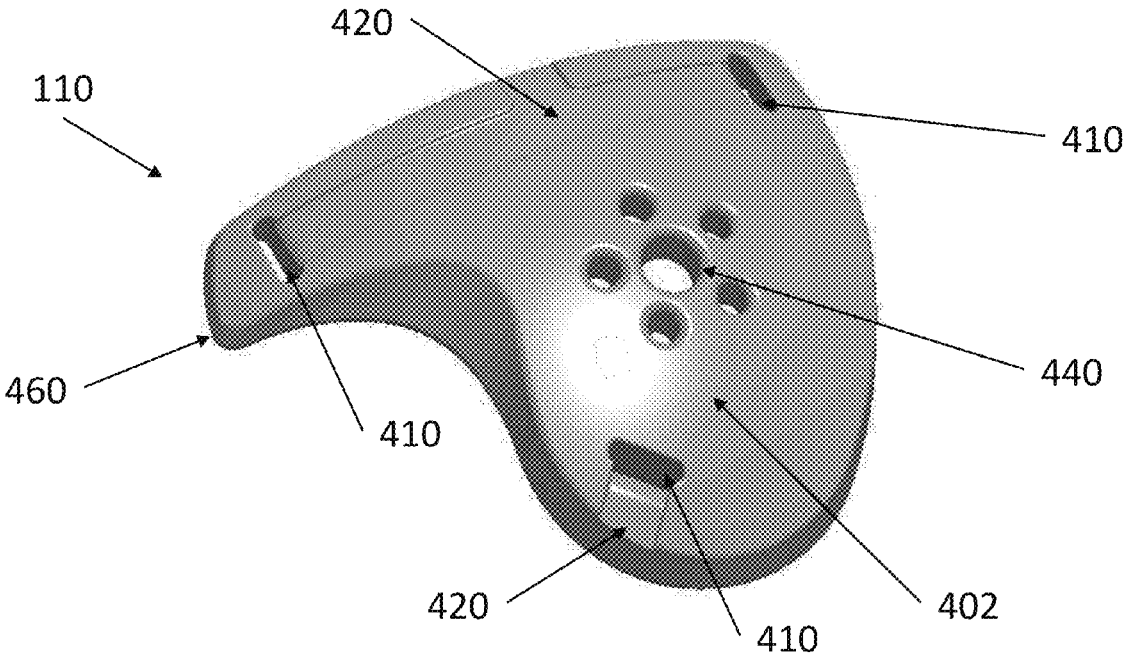
FIG. 5 is a perspective view of the outside surface of a left side pad in accordance with a preferred embodiment of the present invention showing an apparatus for protecting the wearer from head injuries during sporting activities, wherein the right side pad (not presented) is a mirror image thereof.
Figure 6:
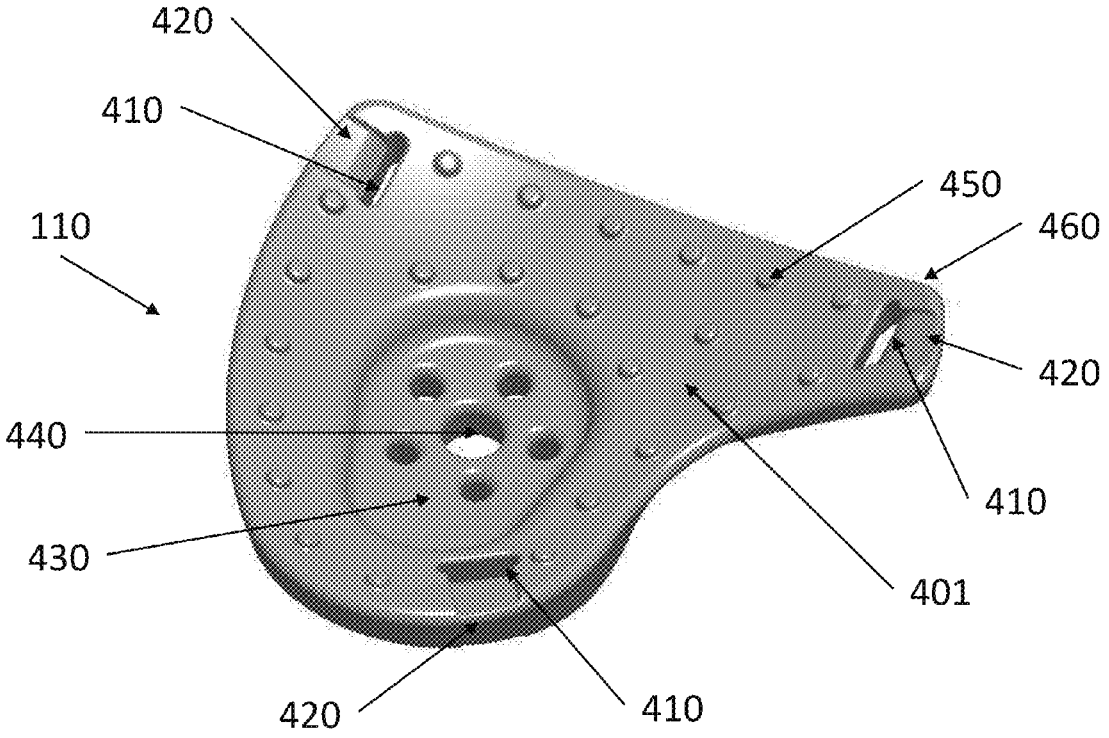
FIG. 6 is a perspective view of the inside surface of a left side pad in accordance with a preferred embodiment of the present invention showing an apparatus for protecting the wearer from head injuries during sporting activities, wherein the right side pad (not presented) is a mirror image thereof.

Referring to FIGS. 5 and 6, an embodiment of the present invention includes, but is not limited to, a left side pad 110 wherein said side pad is a single, contiguous and homogeneous structure with a substantially concave inner surface 401 and a substantially convex outer surface 402, and incorporates various safety and structural features. The right side pad 120 is a mirror image of the left side pad 110 and incorporates the same features. The pad may include, but is not limited to, slots 410 and channels 420 designed to accept straps from the strap system. The recessed channels for the straps have a taper that goes from small to large, thereby allowing the side pad to be tipped upward, or downward to accommodate the wearer's personal fit, while still constraining the strap inside the channel. The side pads further include a molded ear cup 430 creating a recessed area on the inner surface 401. A plurality of apertures 440 extending from the inner surface 401 to the outer surface 402 in the area of the ear cup 430 provide for ventilation and unobstructed hearing by the wearer. While it contemplated to be within the scope of the present invention that this aperture feature may be accomplished with any cross-sectional shape (circle, oval, or polygonal), the hexagonal shape may be chosen in this embodiment (although not shown) because it disperses the energy of an impact better than other shapes in addition to providing ventilation. A plurality of raised protrusions, or dimples 450, extending normal to the inner surface 401 provide a first shock absorbing mechanism in the event of a force being applied to the outer surface. The dimples 450 also provide for airflow and ventilation between the apparatus and the wearer's skin, thus promoting improved hygiene and comfort. An upper portion 460 of the side pad extends forward and away from the ear cup 430 in order to provide protection to the wearer's temple.

Figure 7:
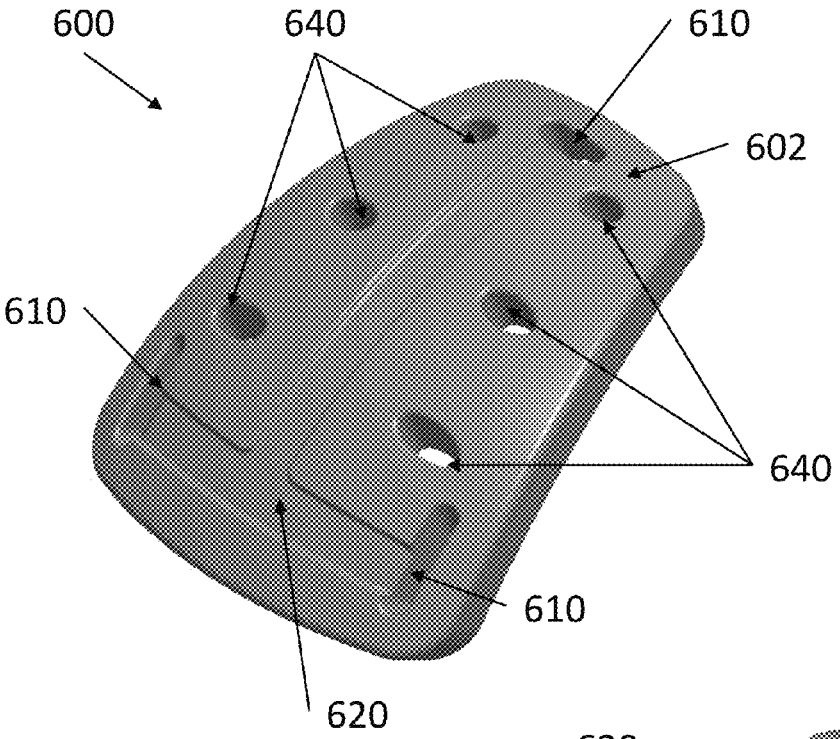
FIG. 7 is a perspective view of the outside surface of a cranial pad in accordance with a preferred embodiment of the present invention showing an apparatus for protecting the wearer from head injuries during sporting activities.
Figure 8:
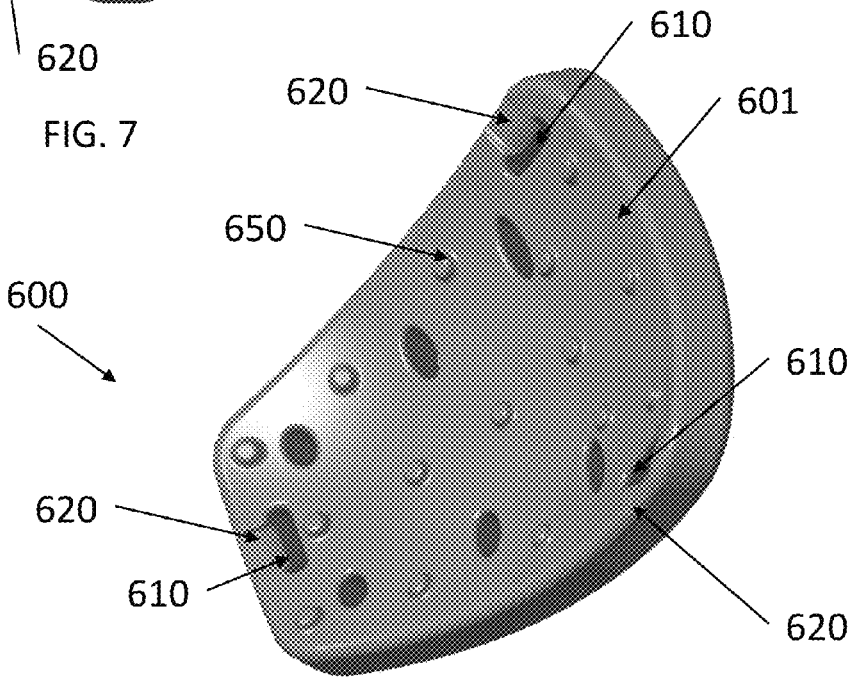
FIG. 8 is a perspective view of the inside surface of a cranial pad in accordance with a preferred embodiment of the present invention showing an apparatus for protecting the wearer from head injuries during sporting activities.

Referring to FIGS. 7 and 8, an embodiment of the present invention includes, but is not limited to, a cranial pad 600 wherein said cranial pad is a single, contiguous structure with a substantially concave inner surface 601 and a substantially convex outer surface 602, and incorporates various safety and structural features. The same cranial pad 600 may be used as the front cranial pad 130 and the rear cranial pad 140 depending on where it is threaded onto the strap system 150. The cranial pad may include, but is not limited to, slots 610 and channels 620 designed to accept straps from the strap system. A plurality of apertures 640 extending from the inner surface 601 to the outer surface 602 provide for ventilation. While it contemplated to be within the scope of the present invention that this aperture feature may be accomplished with any cross-sectional shape (circle, oval, or polygonal), the hexagonal shape may be chosen in this embodiment (although not shown) because it disperses the energy of an impact better than other shapes in addition to providing ventilation. A plurality of raised protrusions, or dimples 650, extending normal to the inner surface 601 provide a first shock absorbing mechanism in the event of a force being applied to the outer surface 602. The dimples 650 also provide for airflow and ventilation between the apparatus and the wearer's skin, thus promoting improved hygiene and comfort.

Figure 9:
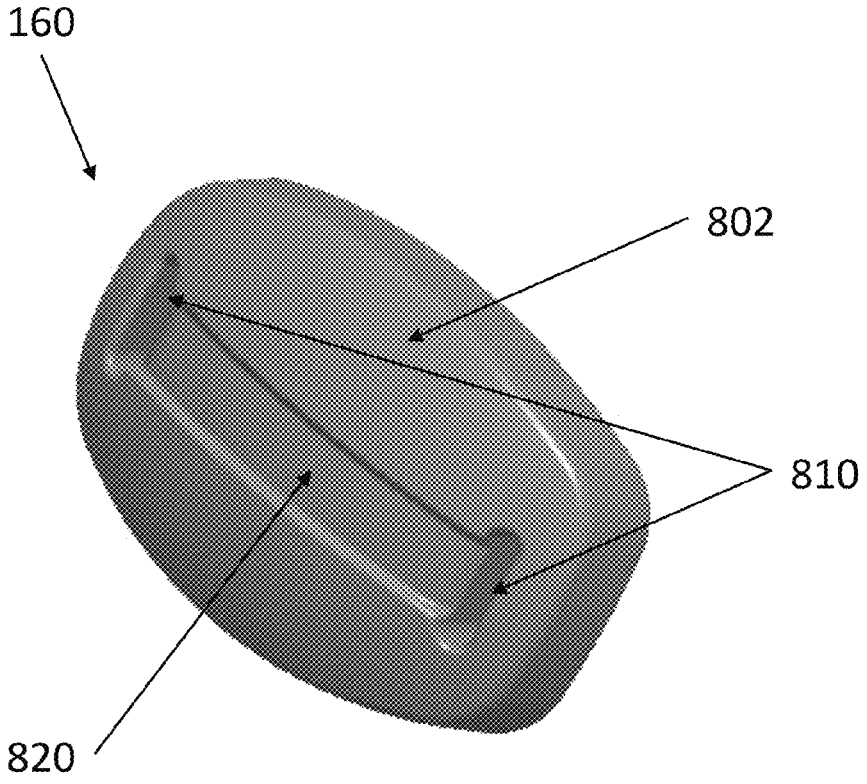
FIG. 9 is a perspective view of the outside surface of a chin pad in accordance with a preferred embodiment of the present invention showing an apparatus for protecting the wearer from head injuries during sporting activities.
Figure 10:
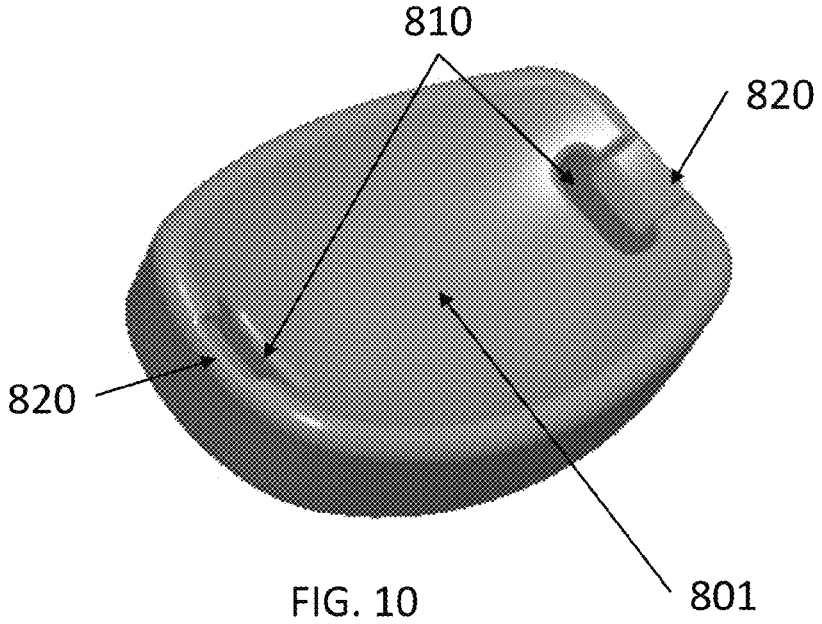
FIG. 10 is a perspective view of the inside surface of a chin pad in accordance with a preferred embodiment of the present invention showing an apparatus for protecting the wearer from head injuries during sporting activities.
Figure 11:
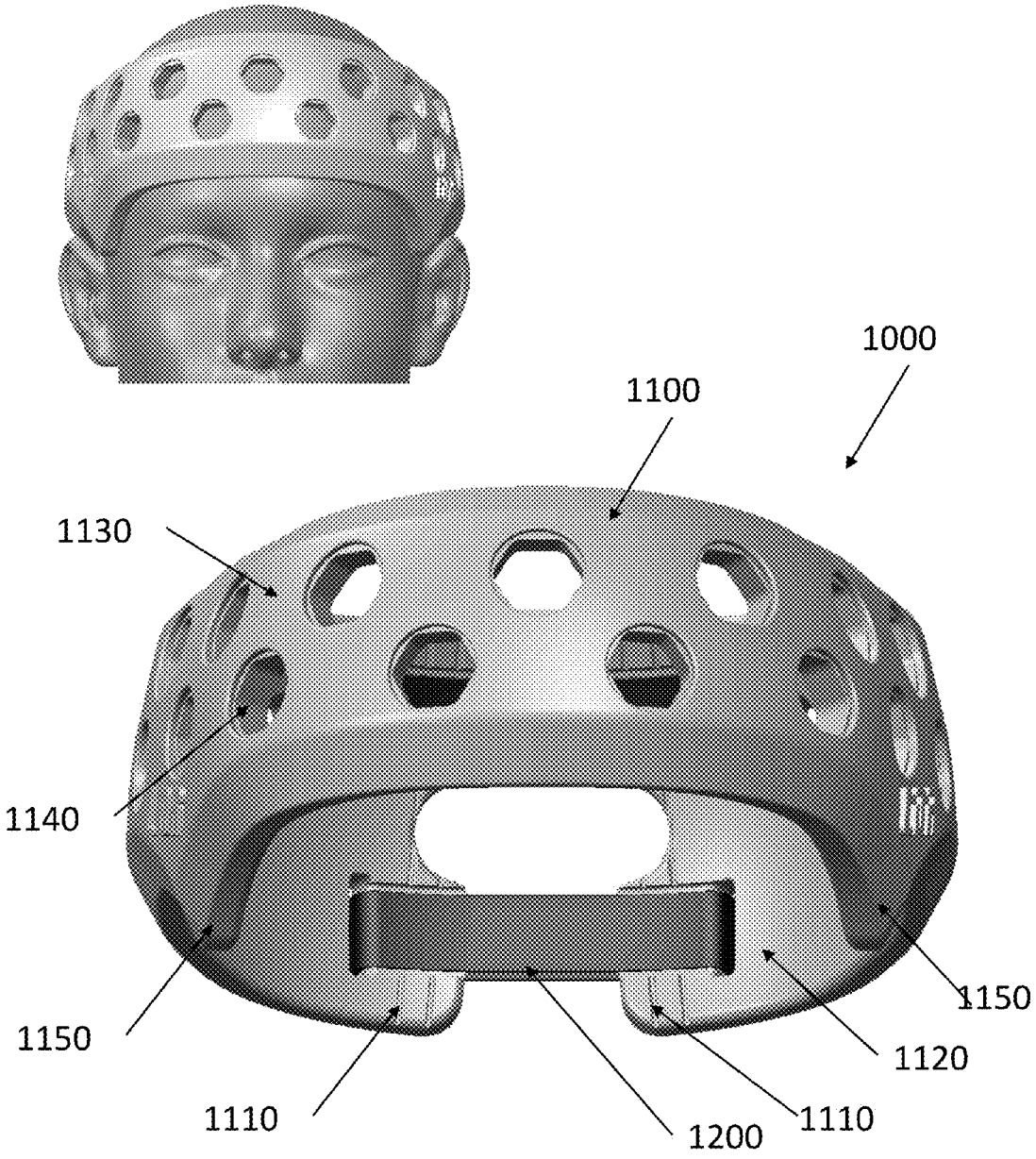
FIG. 11 is a front view in accordance with an embodiment of the present invention showing an apparatus for protecting the wearer from head injuries during sporting activities. An additional view of the apparatus in use on a human head is shown for reference only.
Figure 12:
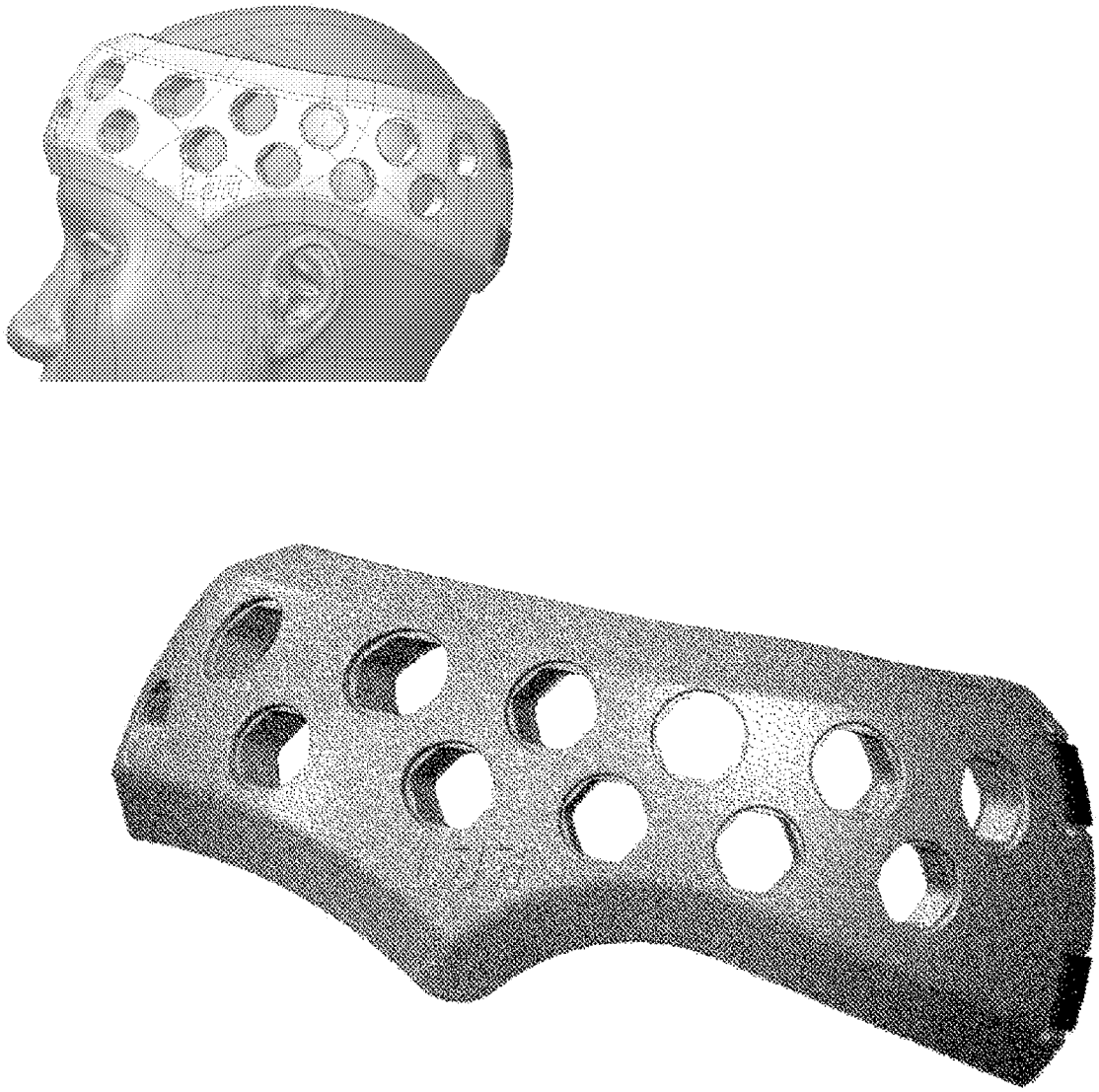
FIG. 12 is a left side view in accordance with an embodiment of the present invention showing an apparatus for protecting the wearer from head injuries during sporting activities, wherein the right side view (not presented) is a mirror image thereof. An additional view of the apparatus in use on a human head is shown for reference only.
Figure 13:
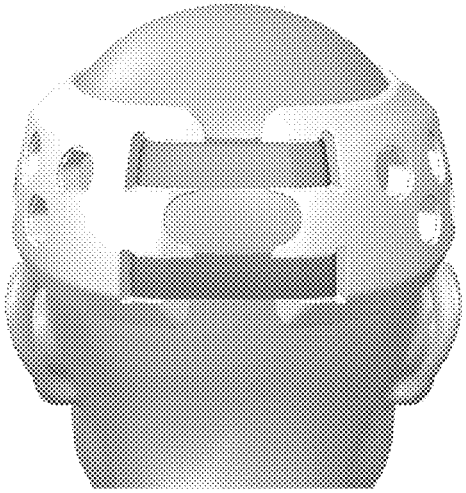
FIG. 13 is a back view in accordance with an embodiment of the present invention showing an apparatus for protecting the wearer from head injuries during sporting activities. An additional view of the apparatus in use on a human head is shown for reference only.
Figure 13:
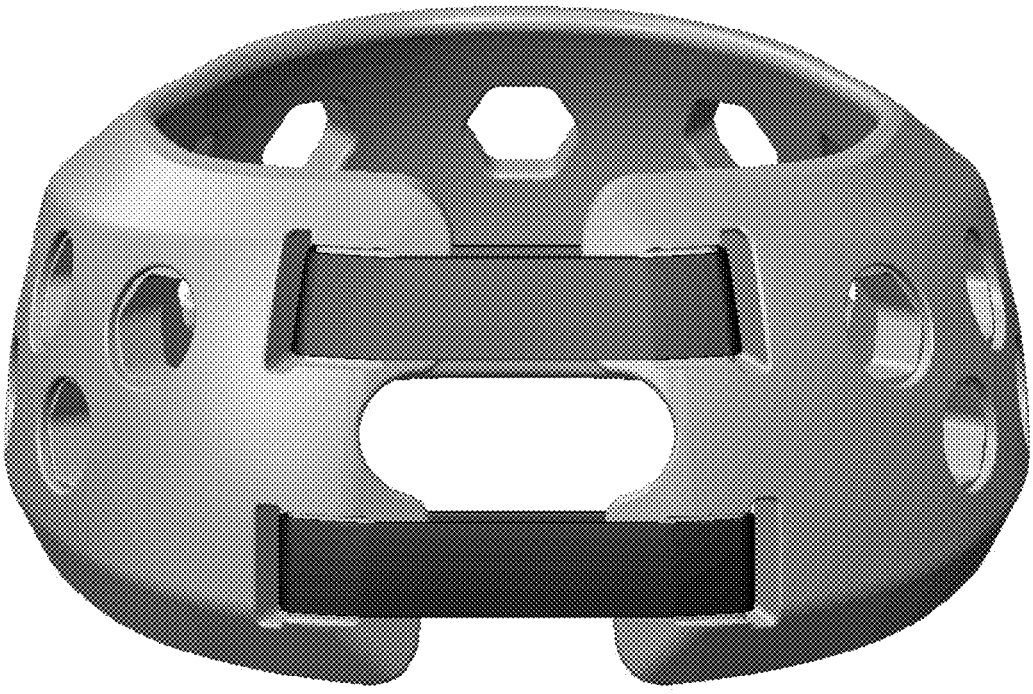
Figure 14:
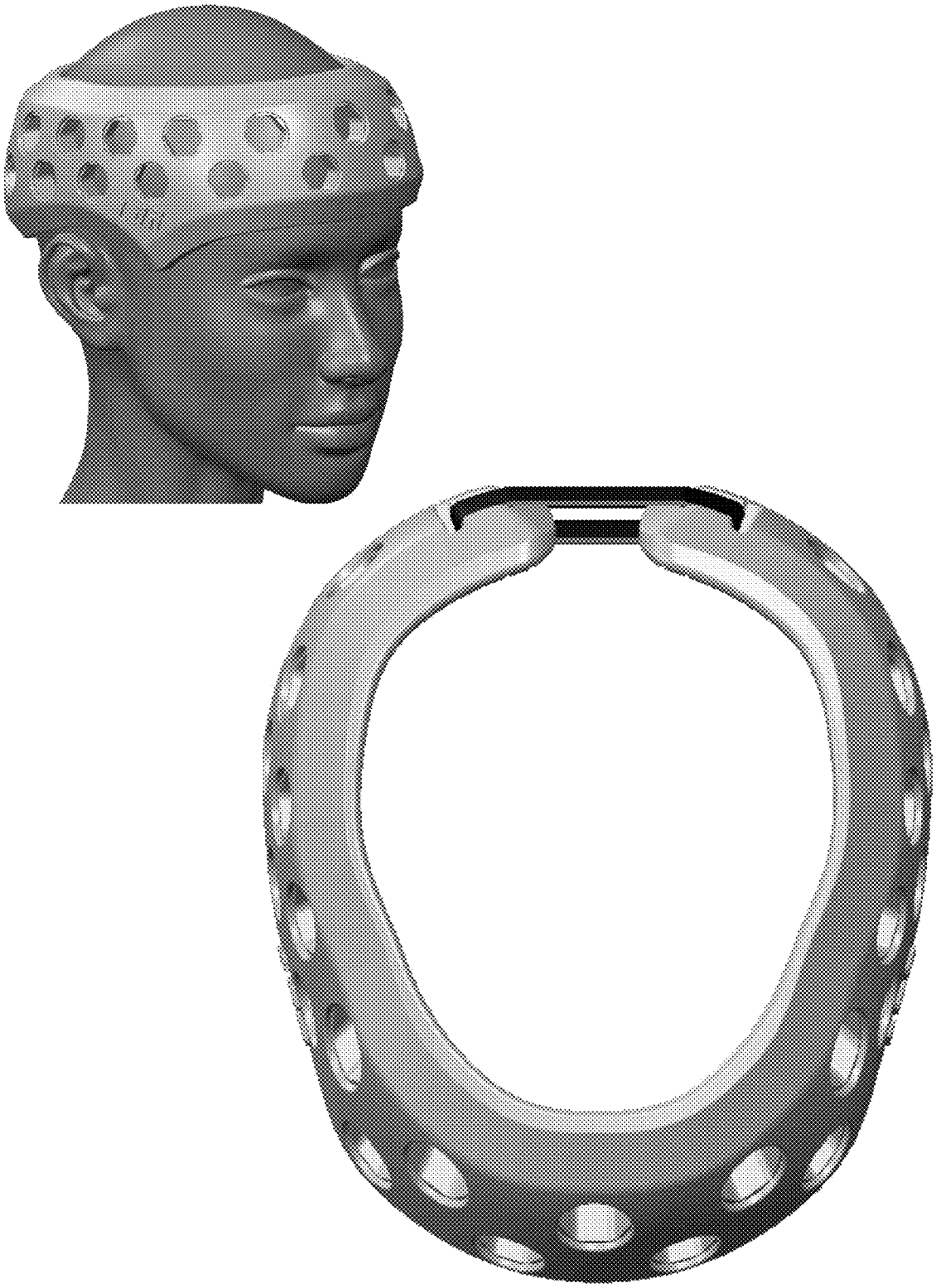
FIG. 14 is a top view in accordance with an embodiment of the present invention showing an apparatus for protecting the wearer from head injuries during sporting events. An additional view of the apparatus in use on a human head is shown for reference only.
Figure 15:
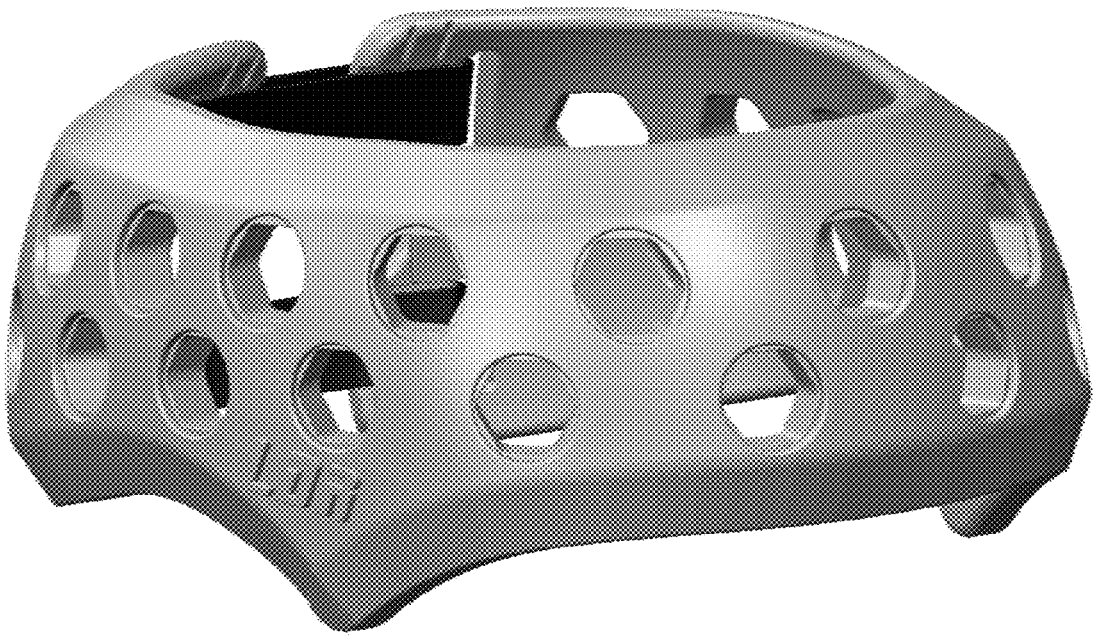
FIG. 15 is a front perspective view in accordance with an embodiment of the present invention showing an apparatus for protecting the wearer from head injuries during sporting activities.
Figure 16:
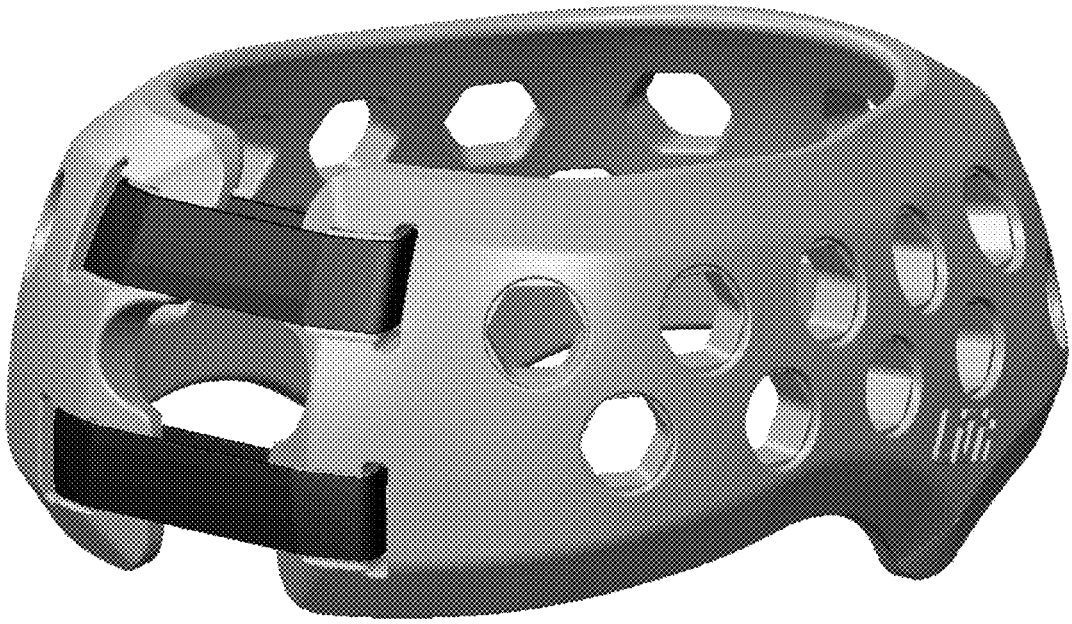
FIG. 16 is a back perspective view in accordance with an embodiment of the present invention showing an apparatus for protecting the wearer from head injuries during sporting activities.
Figure 17:
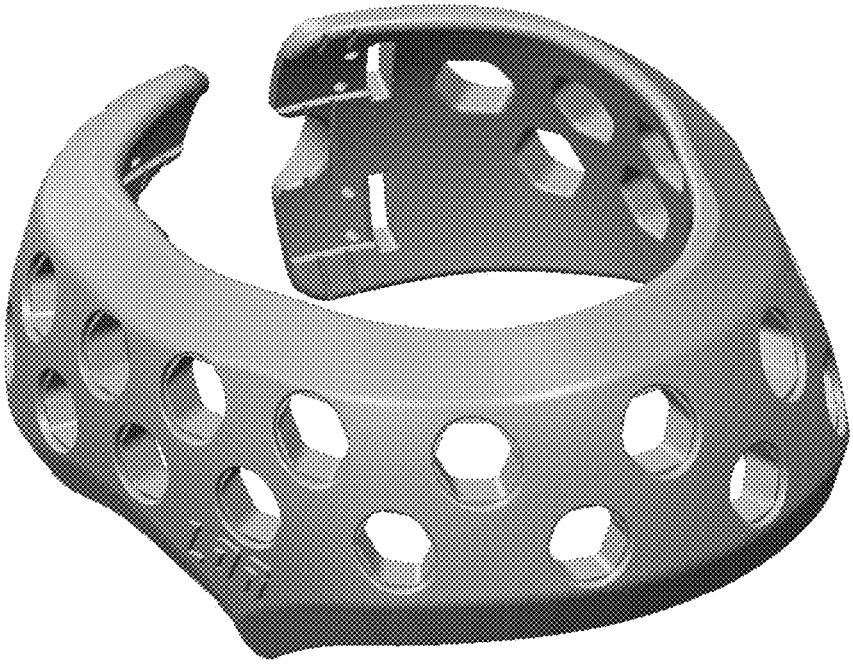
FIG. 17 is a front perspective view in accordance with an embodiment of the present invention showing an apparatus for protecting the wearer from head injuries during sporting activities, with straps omitted.
Figure 18:
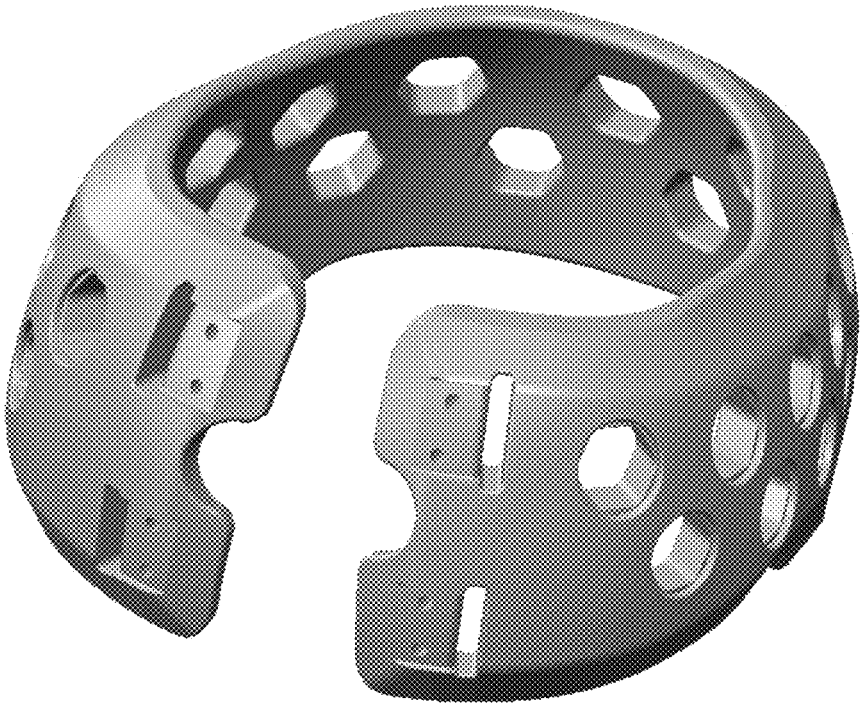
FIG. 18 is a back perspective view in accordance with an embodiment of the present invention showing an apparatus for protecting the wearer from head injuries during sporting activities, with straps omitted.

Referring to FIGS. 9 and 10, an embodiment of the present invention includes, but is not limited to, a chin pad 160 wherein said chin pad is a single, contiguous structure with a substantially concave inner surface 801 and a substantially convex outer surface 802. The chin pad may include, but is not limited to, slots 810 and channels 820 designed to accept straps from the strap system.

Referring to FIGS. 11 through 18, an embodiment of the present invention includes, but is not limited to, a headgear safety apparatus 1000 where the headgear safety apparatus is comprised of a wrap-around pad 1100 to provide impact resistance and a one or more strap 1200 configured to allow for proper fit on a user's head.

It will be evident to one having skill in the art that the one or more strap 1200 may be accomplished by various means including, but not limited to, fabric, elastic, or rubber, and may be adjustable through its inherent elasticity or by employing a mechanical means such as hook and loop fastener, snaps, or buckles.

The wrap-around pad 1100 is a single, contiguous and homogeneous structure with a substantially concave inner surface 1120 and a substantially convex outer surface 1130. A plurality of apertures 1140 extend from the outer surface to the inner surface and are configured to provide ventilation and to disperse energy in an impact event. In the embodiment shown in FIGS. 11 through 18, the apertures are substantially hexagonal in cross-section with a circular recess surrounding the aperture on the outer surface. While it contemplated to be within the scope of the present invention that this aperture feature may be accomplished with any cross-sectional shape (circle, oval, or polygonal), the hexagonal shape is chosen in this embodiment because it disperses the energy of an impact better than other shapes. The embodiment shown in FIGS. 11 through 18 further show extended portions of the pad 1150 which are configured to provide protection to the user's temples.

Scored, or recessed, areas 1110 of the inner surface may be provided in order for the user to trim away parts of the pad in order to provide for a proper fit on a smaller head.

While not shown in this embodiment, it is contemplated that the other safety features disclosed herein may be incorporated in this embodiment. For example, the raised protrusions, or dimples, may be added to the inner surface in order to improve ventilation and to provide a first shock-absorbing mechanism in an impact event. Additionally, tapered channels may be used in order to constrain the straps while allowing for adjustability by the user.

Figure 19:
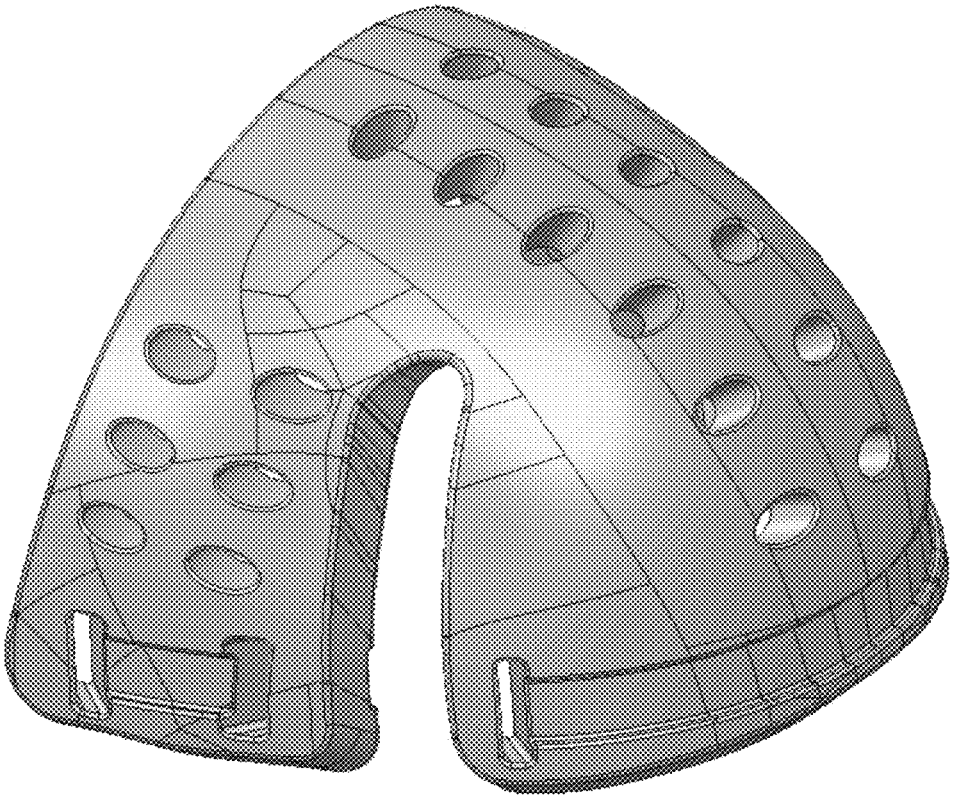
FIG. 19 is a perspective view in accordance with an embodiment of the present invention showing an apparatus for protecting the wearer from head injuries during sporting activities.

FIG. 19 discloses yet another embodiment of the invention showing an apparatus for protecting the head of a user. This embodiment discloses a unitary pad configured to protect the front (or rear) and side portions of the user's cranium. Apertures for ventilation are shown as well as slots and channels configured to accept a strap system (the strap system is not depicted in this figure).

It is contemplated as part of the present invention that embodiments thereof may be manufactured by an injection molded foam process utilizing closed-cell, ethylene vinyl acetate foam with an anti-microbial additive. The molding process and choice of foam material allow for all of the protective and functional features of the apparatus to be molded into one-piece pads with a smooth, continuous skin. Manufacturing the pads in this way creates a sturdy, protective, one-piece pad that is washable and anti-microbial.

In light of the foregoing description, it should be recognized that embodiments in accordance with the present invention can be realized in numerous configurations contemplated to be within the scope and spirit of the claims. Additionally, the description above is intended by way of example only and is not intended to limit the present invention in any way, except as set forth in the claims.

What is claimed is:

1. A headgear safety apparatus, the apparatus comprising:
a left side pad made out of injected molded foam;
a right side pad made out of injected molded foam;
a front cranial pad made out of injected molded foam;
a rear cranial pad made out of injected molded foam;
a chin pad made out of injected molded foam; and
a strap system;
wherein:
the left side pad and right side pad are mirror images of each other;
the strap system is further comprised of a one or more strap;
the left side pad, right side pad, front cranial pad, rear cranial pad, and chin pad each further comprise a one or more slot and a one or more channel configured to accept the one or more strap from the strap system; and
the left side pad, right side pad, front cranial pad, rear cranial pad, and chin pad are releasably connected by said strap system to form said headgear safety apparatus where the left side pad and the right side pad are located opposite each other, the front cranial pad and the rear cranial pad are located opposite each other, and the chin pad is located below the left side pad and the right side pad.

* * * * *